US005647261A

United States Patent [19]

Wierenga

[11] Patent Number: 5,647,261

[45] Date of Patent: Jul. 15, 1997

[54] SHEET CUTTING DEVICE

[75] Inventor: Marc K. Wierenga, Grand Rapids, Mich.

[73] Assignee: Bulman Products, Inc., Grand Rapids, Mich.

[21] Appl. No.: 378,195

[22] Filed: Jan. 25, 1995

[51] Int. Cl.[6] ..... B26D 7/00

[52] U.S. Cl. ..... 83/649; 83/694; 83/597

[58] Field of Search ..... 83/649, 636, 349, 83/341, 694, 597, 650

[56] References Cited

U.S. PATENT DOCUMENTS

| | | | |
|---|---|---|---|
| 3,203,292 | 8/1965 | Schmermund | 83/341 |
| 3,530,761 | 9/1970 | Erwin | 83/636 X |
| 3,741,052 | 6/1973 | Frost et al. . | |
| 3,760,669 | 9/1973 | Rosenthal et al. . | |
| 3,896,691 | 7/1975 | Granger et al. | 83/49 X |
| 3,898,902 | 8/1975 | Cailloux . | |
| 3,911,775 | 10/1975 | Pearson | 83/636 X |
| 3,918,339 | 11/1975 | Cailloux | 83/597 X |
| 3,919,905 | 11/1975 | Hoffman | 83/649 X |
| 3,943,809 | 3/1976 | Schoppee et al. | 83/349 X |
| 4,056,024 | 11/1977 | Baert et al. . | |
| 4,077,287 | 3/1978 | Makeev et al. . | |
| 4,089,242 | 5/1978 | Gramling . | |
| 4,119,003 | 10/1978 | Corse | 83/341 |
| 4,143,566 | 3/1979 | Laciak et al. . | |
| 4,282,808 | 8/1981 | Clay . | |
| 4,416,176 | 11/1983 | Forthmann . | |
| 4,433,878 | 2/1984 | Rosenthal . | |
| 4,476,760 | 10/1984 | Block et al. . | |
| 4,478,121 | 10/1984 | Ritter et al. . | |
| 4,488,466 | 12/1984 | Jones | 83/649 X |
| 4,510,831 | 4/1985 | Jager et al. | 83/636 X |
| 4,510,841 | 4/1985 | Farran et al. . | |
| 4,781,336 | 11/1988 | Rosenthal et al. . | |
| 4,790,226 | 12/1988 | Tsuchida . | |
| 4,823,663 | 4/1989 | Hamlin | 83/649 X |
| 4,936,177 | 6/1990 | Ozawa et al. | 83/636 X |
| 5,042,351 | 8/1991 | Rosenthal . | |
| 5,174,182 | 12/1992 | Rosenthal et al. . | |
| B1 3,760,669 | 11/1987 | Rosenthal et al. . | |
| B2 3,760,669 | 10/1990 | Rosenthal et al. . | |

OTHER PUBLICATIONS

Rosenthal Manufacturing Company, Inc.'s Wrap–O–Matic Sheeter Sectional View Drawing, dated Nov., 1972.

*Primary Examiner*—Rinaldi I. Rada
*Assistant Examiner*—Elizabeth Stanley
*Attorney, Agent, or Firm*—Price, Heneveld, Cooper, DeWitt & Litton

[57] ABSTRACT

An automated sheet cutting device includes a frame, a fixed linearly-shaped blade secured to the frame, and a moveable blade-supporting mechanism also secured to the frame for operably supporting a moveable blade against the fixed blade. In particular, the blade-supporting mechanism includes a swing arm pivotally secured to the frame for movement about a first axis, and further includes a blade holder pivotally secured to the swing arm for movement about a second axis. An actuator connected to the swing arm rotates the blade-supporting mechanism about the first axis, and a spring connected to the blade holder pivots the blade holder about the second axis so that the moveable blade continuously engages the fixed blade. The fixed and moveable blades comprise elongated linearly shaped bars, but are oriented at an angle so that the blades contact along a continuously shifting shearing point as the moveable blade is moved curvilinearly downwardly across the fixed blade with a sweeping motion. The sweeping motion "kicks" each newly cut section of sheet material away from the blades. The cutting device also includes a roll of sheet material rotatably supported on the frame, and a feeder for feeding the sheet material past the blades. The feeder includes a stepper motor and a speed reduction device operably connected to a friction roller to expend sheet material at a desired rate. A controller is operably connected to the feeder and the actuator so that the cutting device can cut a series of sheet sections from the roll, in an automatic, semi-automatic, or manual mode.

16 Claims, 6 Drawing Sheets

SHEET CUTTING DEVICE

BACKGROUND OF THE INVENTION

The present invention concerns a device for cutting sheet materials, and more particularly concerns an automated sheet cutting device having a blade arrangement that provides improved blade life and further that assists in moving cut sheet sections away from the cutting blade.

Sheet cutting devices, sometimes called "sheeting machines", are often used to cut sections of sheet material from a roll of sheet material. Some of these machines use long blades that extend across the width of the sheet material. However, the thinness and flexible characteristics of the sheet material make the cutting process very sensitive to blade wear or surface defects along the cutting edges of the blades. Thus, the blades must typically be sharpened or otherwise maintained more often than desired. Further, where non-linear or shaped blades are used, great care must be used when sharpening the blades to assure that the proper shape is given the cutting edges.

Aside from blade maintenance, the sheet materials are usually very thin, flexible polymeric or paper sheets that are not electrically conductive. Static build up and/or small defects in the sheets along the cut line on the sheets can cause jamming, bunching, snagging, and the like. This causes sheet material to be wasted, and also results in work stoppages while the jammed material is cleared. Thus, a sheet cutting device having an improved blade arrangement and mechanism solving the aforementioned problems is desired.

SUMMARY OF THE INVENTION

The present invention includes a sheet cutting device for cutting sheet material into sections. The sheet cutting device includes a support, an elongated fixed blade secured to the support, a movable blade and a blade-supporting mechanism also operably secured to the support for supporting the moveable blade. The blade-supporting mechanism includes a swing member pivotally connected to the support for movement about a first axis and a blade holder pivotally connected to the swing member for movement about a second axis, the first and second axes being spaced apart. An actuator is operably connected to the blade-supporting mechanism for rotating the blade-supporting mechanism about the first axis, and a spring is attached to the blade holder for biasing the blade holder about the second axis so that the moveable blade continuously shearingly engages the fixed blade when rotated by the actuator.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
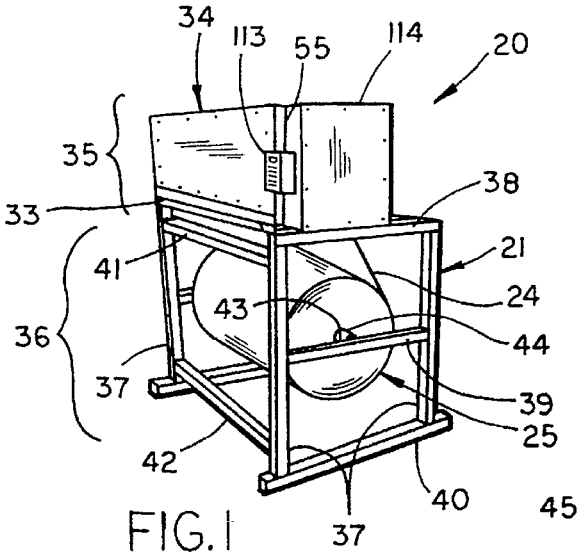
FIG. 1 is a perspective view of a sheet cutting device embodying the present invention.

For purposes of description herein, the terms "upper," "lower," "right," "left," "rear," "front," "vertical," "horizontal," and derivatives thereof shall relate to the invention as oriented in FIG. 1, the "front" of the device being generally toward the left of the figure. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5A:
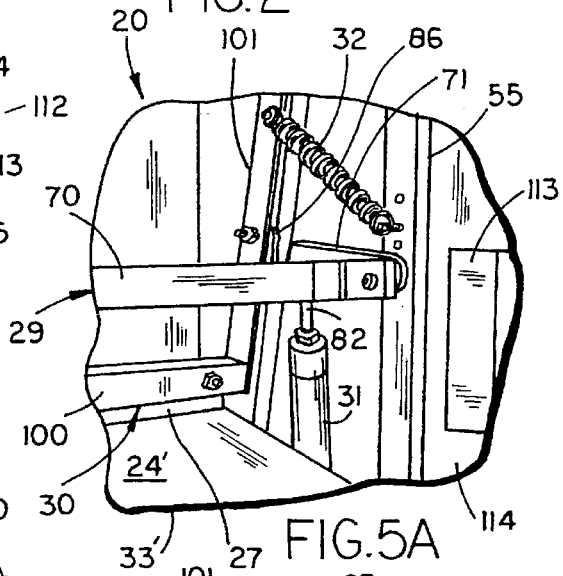
FIG. 5A is an enlarged perspective view similar to FIG. 5, but with the moveable blade being shown in a lowered position.
Figure 4:
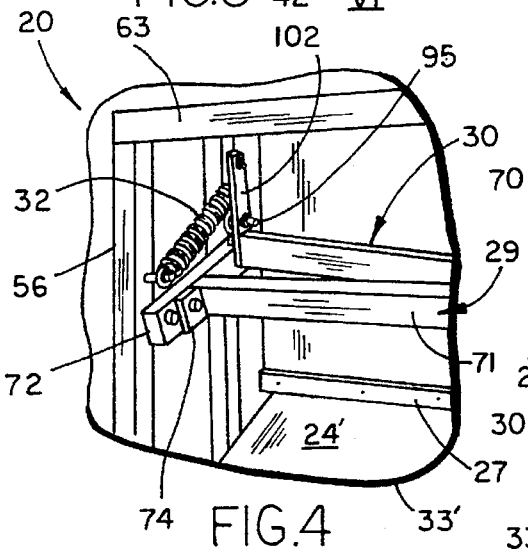
FIG. 4 is an enlarged perspective view of the left side of the outlet aperture of the sheet cutting device shown in FIG. 1, the safety guard being removed to reveal the blade arrangement, the moveable blade being shown in a raised position.

A sheet cutting device 20 (FIGS. 1 and 6) includes a frame 21, a cutter 22 operably mounted on frame 21 for cutting sheet material 24, and a sheet feeder 23 for feeding sheet material 24 from a roll 25 of sheet material to cutter 22. Cutter 22 (FIG. 7) includes a fixed blade 26 and a moveable blade 27 operably supported on a blade-supporting mechanism 28 for shearing movement across fixed blade 26. In particular, blade-supporting mechanism 28 includes a swing member 29 pivotally secured to the frame 21, and a blade holder 30 pivotally secured to swing member 29. The moveable blade 27 is attached to blade holder 30 by a means for holding, such as fastener/bolts/nuts (FIG 5A). An actuator 31 is operably connected to swing member 29 to rotate blade-supporting mechanism 28, and a spring 32 is connected to blade holder 30 for biasing moveable blade 27 continuously against fixed blade 26. As moveable blade 27 is moved shearingly past fixed blade 26, it moves with a curvilinear sweeping motion that "kicks" each newly cut section 24' of sheet material away from the cutter 22 toward an outlet aperture 33 in a metal housing 34 attached to and covering the upper part of frame 21. The "kick" reduces the tendency of the sheet material 24 to jam, snag or bunch within the housing 34. The configuration also allows the blades 26 and 27 to be made from a linear bar, and further causes the blades 26 and 27 to engage in a manner that makes them wear better and in a manner that reduces the amount of sharpening required to keep the blades in good operating condition.

Figure 2:
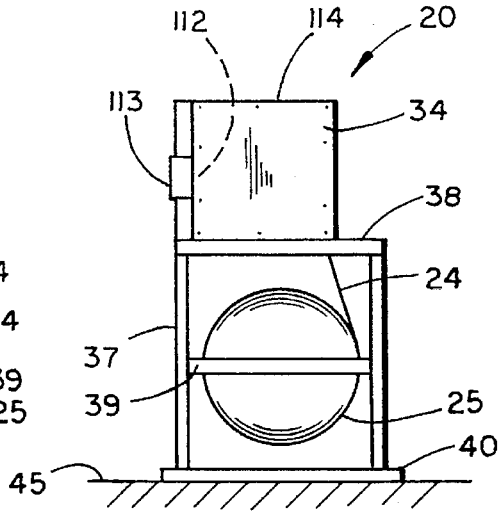
FIG. 2 is a side view of the sheet cutting device shown in FIG. 1.
Figure 3:
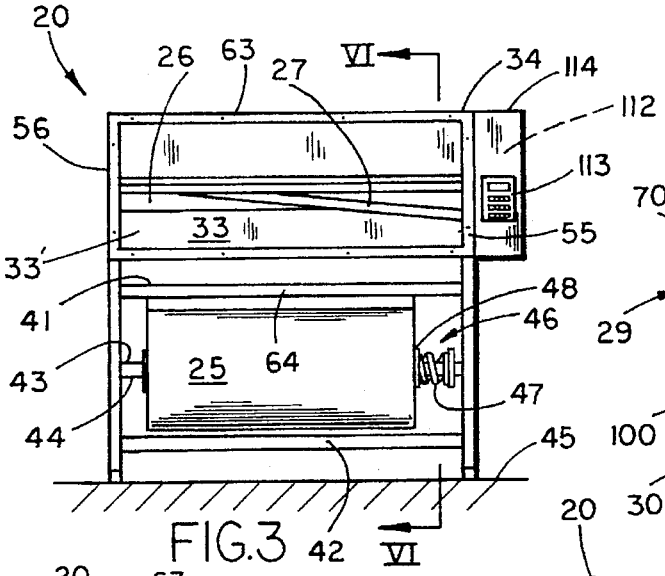
FIG. 3 is a front view of the sheet cutting device shown in FIG. 1.

Frame 21 (FIG. 1) includes an upper section 35 for supporting cutter 22 and feeder 23, and a lower section 36 for supporting upper section 35 and roll 25. Lower section 36 includes a rigid rectangular matrix of corner posts 37 and horizontal reinforcement beams including upper side beams 38, intermediate side beams 39, floor engaging side beams 40, upper cross beams 41 and lower cross beams 42. Opposing brackets 43 on the inside of intermediate side beams 39 operably support the ends of axle 44. Axle 44 supports roll 25 above the building floor 45 (FIGS. 2–3) so that roll 25 can be rotated as sheet material 24 is drawn by feeder 23 and fed into cutter 22. A friction brake 46 (FIG. 3) is mounted on axle 44, and includes a spring 47 and a frictional disk 48 engaging roll 25. Spring 47, in addition to biasing disk 48 into frictional engagement with the side of roll 25, also prevents roll 25 from wandering axially unacceptably on axle 44. The "rear" side 49 of lower section 36 (FIG. 1) is open to facilitate loading a new roll 25 and axle onto brackets 43, such as with a fork truck or carrier.

Figure 6:
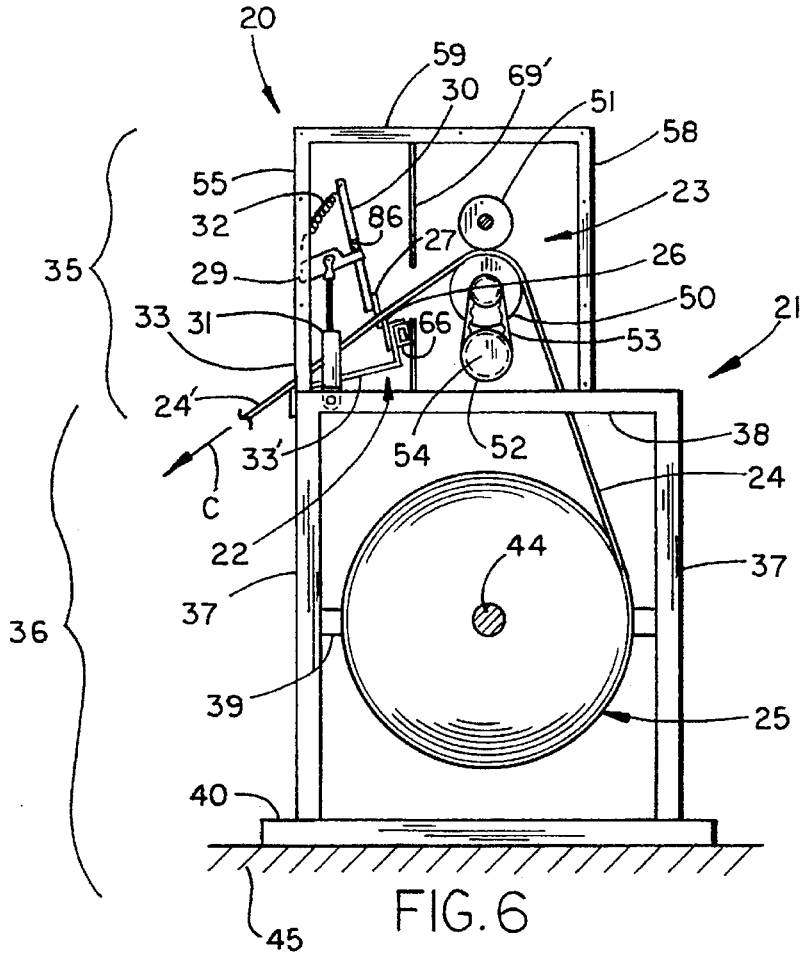
FIG. 6 is a cross sectional view of the sheet cutting device taken along the line VI—VI in FIG. 3.

Sheet material 24 (FIG. 6) extends from roll 25 upwardly through the feeder 23 toward cutter 22. In particular, sheet material 24 is fed upwardly around a friction drive wheel 50 (FIG. 6). Notably, sheet material 24 can be substantially any flexible material, but it is contemplated that sheet material 24 will most typically be a thin polymeric film, polymeric foam, or paper product for wrapping or packaging. An idler wheel 51 presses sheet material 24 against drive wheel 50. Drive wheel 50 is mounted on upper frame section 35 and operably connected to a drive sprocket 52 by a non-slip transversely grooved drive belt 53. Drive sprocket 52 is driven by a stepper motor/speed reducer 54, which is operably attached to upper frame section 35.

Figure 5:
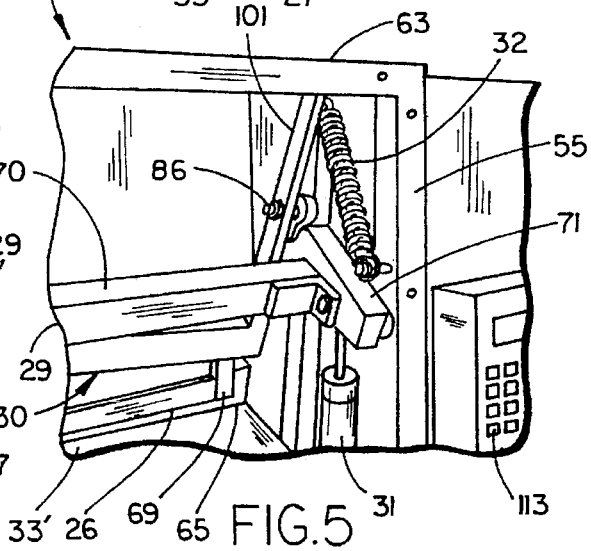
FIG. 5 is an enlarged perspective view of the right side of the outlet aperture of the sheet cutting device shown in FIG. 1, the safety guard being removed to reveal the blade arrangement, the moveable blade being shown in a raised position.
Figure 11:
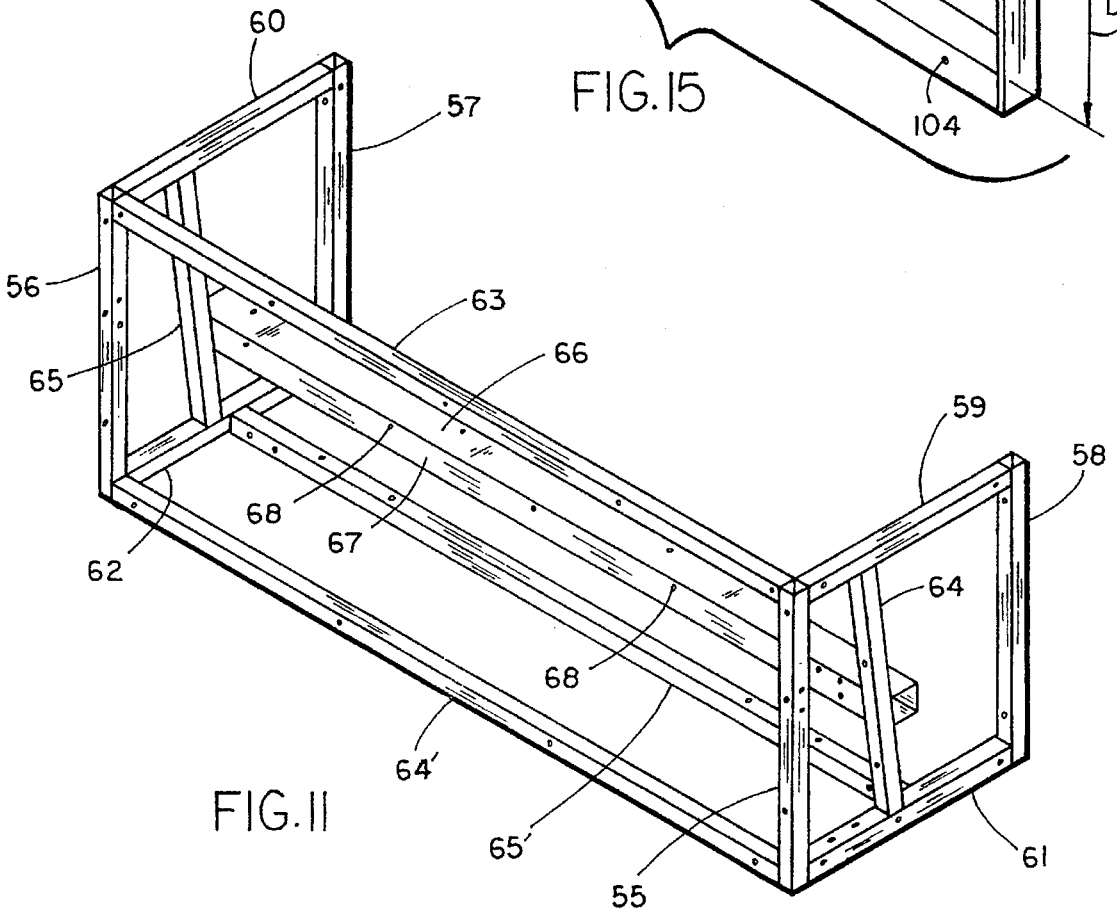
FIG. 11 is a perspective view of the upper portion of the frame.
Figure 17:
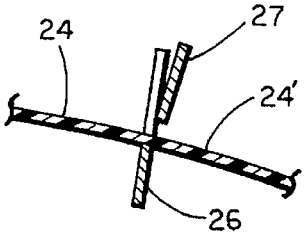
FIGS. 17, 19, 21, and 23 are cross sectional views taken along the lines XVII—XVII, XIX—XIX, XXI—XXI, and XXIII—XXIII, respectively in FIGS. 16, 18, 20 and 22.

Upper section 35 includes a rigid matrix rectangular of rigid corner posts 55–58 (FIG. 11), upper and lower side beams 59–62, an upper cross beam 63 and a pair of lower cross beams 64' and 65'. A reinforcement beam 64 extends between upper and lower side beams 59 and 61, and a second reinforcement beam 65 extends between upper and lower side beams 60 and 62. Reinforcement beams 64 and 65 extend at a slight angle from vertical such that they act as an angled brace to rigidify upper section 35. A blade holder 66 for holding the fixed blade (26) is secured to reinforcement beams 64 and 65 and extends horizontally therebetween. The front surface 67 on blade holder 66 is planar and includes holes 68 for receiving fasteners to secure fixed blade 26 to blade holder 66. Reinforcement beams 64 and 65 further are oriented so that blade 26 is held at a desired angle relative to blade 27. (See FIGS. 7 and 18–23). A blade guide 69 (FIG. 5) is secured to an end of fixed blade 26 at an end of front surface 67 to guide movable blade 27 onto fixed blade 26 during the cut-initiating part of the cutting stroke of moveable blade 27. A divider wall 69' extends generally vertically in upper section 35 and separates cutter 22 from feeder 23 (FIG. 6). An aperture in divider wall 69' allows sheet material 24 to pass through wall 69'.

Figure 14:
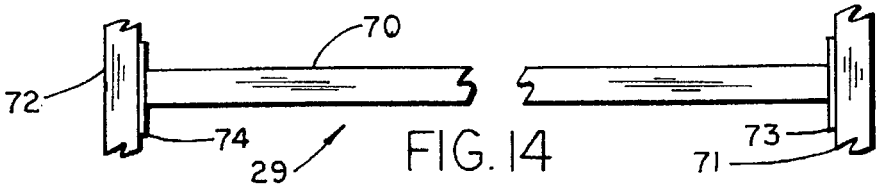
FIG. 14 is a fragmentary front view of the swing arm shown in FIG. 8.

Blade-supporting mechanism 28 (FIG. 7) operably supports movable blade 27 on upper frame section 35, and biases movable blade 27 against fixed blade 26 to create a scissor-like shearing action therebetween for cutting section 24' from sheet material 24. Specifically, swing member 29 (FIG. 14) of blade-supporting mechanism 28 includes a cross piece 70 with a first arm 71 fixedly attached to one end and a second arm 72 fixedly attached to the other end. Cross piece 70 includes a rectangular tubular beam long enough to span the maximum width of roll 25. Perpendicularly extending flanges 73 and 74 are located at the ends of cross size 70.

Figure 12:
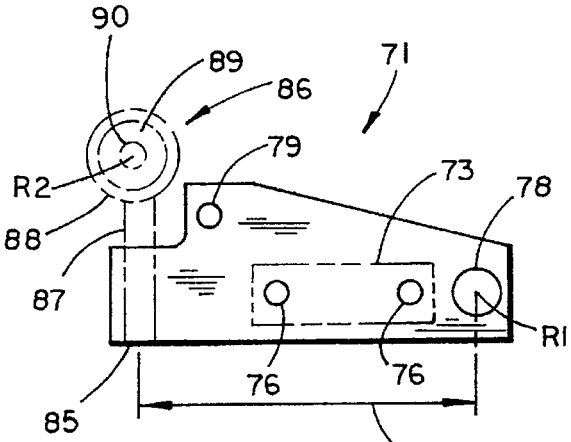
FIG. 12 is an enlarged side view of the left end member shown in FIG. 10.

Arm 71 (FIG. 12) is a flat bar-like member configured for connection to each of the cross piece 70, a pivot on frame 231, and the actuator 31. Specifically, arm 71 includes a pair of holes 76 that align with corresponding holes in flanges 73 of cross piece 70, so that arm 71 can be secure by bolted to cross piece 70. A hole 78 in one end of arm 71 defines a pivot for engaging a pivot pin extending inwardly from post 55 (FIG. 11) of upper frame section 35. A second hole 79 (FIG. 12) spaced from and extending parallel hole 78 is located in a protruding part 80 of arm 71. Second hole 79 receives a pivot pin 81 (FIG. 7) for connecting actuator 31 to arm 71. Specifically, actuator 31, which provides means for moving the moveable blade and its support structure with a curvilinear sweeping motion, includes an extendable rod 82 having the pivot pin 81 operably mounted to an end thereof, and a pneumatic cylinder 83 for extending rod 82. Cylinder 83 is operably connected to and supported on lower frame section 36. Another hole 85 in arm 71 (FIG. 12) extends perpendicularly to holes 78 and 79 and is located proximate actuator engaging hole 79. Hole 85 receives a ball joint rod 86 comprising a threaded stud 87 for engaging hole 85 and a protruding enlarged end 88 supporting a ball 89. Ball 89 includes a hole 90 so that it forms an angularly adjustable joint for rotatably supporting the right end of blade holder 30.

Figure 7:
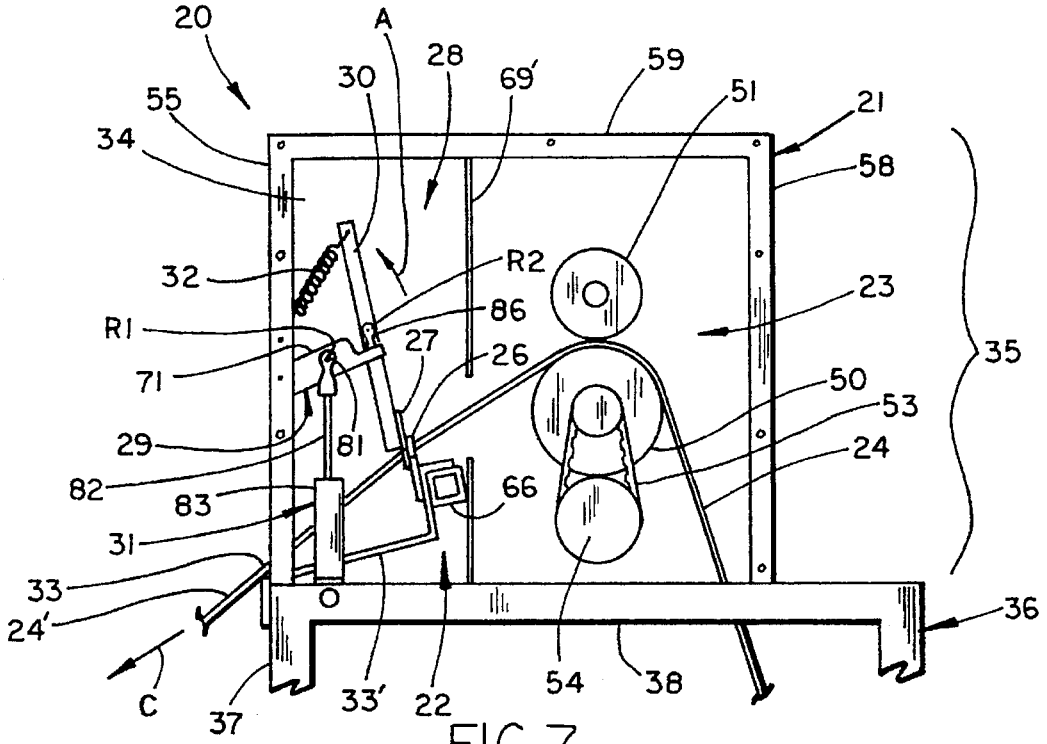
FIG. 7 is an enlarged fragmentary view of the upper portion of the sheet cutting device shown in FIG. 6.
Figure 8:
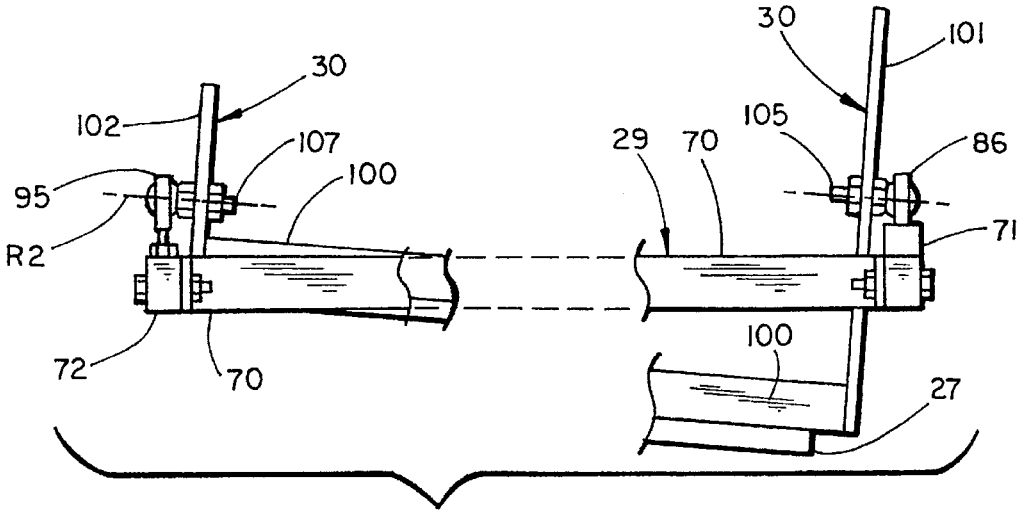
FIG. 8 is an enlarged fragmentary view of the blade-supporting mechanism of the sheet cutting device, including the swing arm, the blade holder, and the moveable blade.
Figure 9:
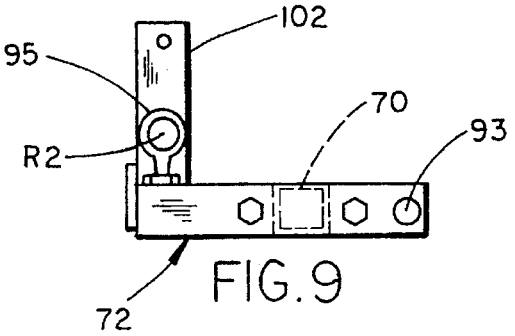
FIG. 9 is a side view of the left side of the blade-supporting mechanism shown in FIG. 8.
Figure 10:
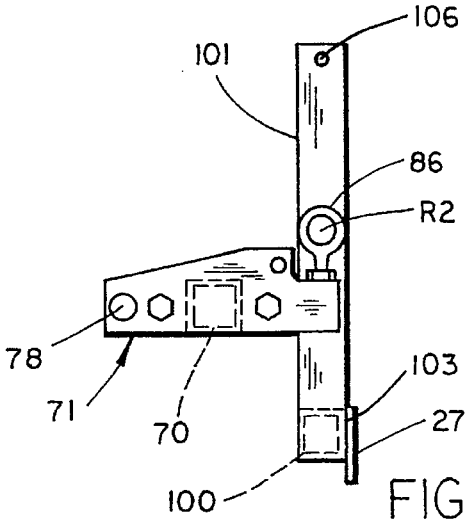
FIG. 10 is a side view of the right side of the blade-supporting mechanism shown in FIG. 8.
Figure 13:
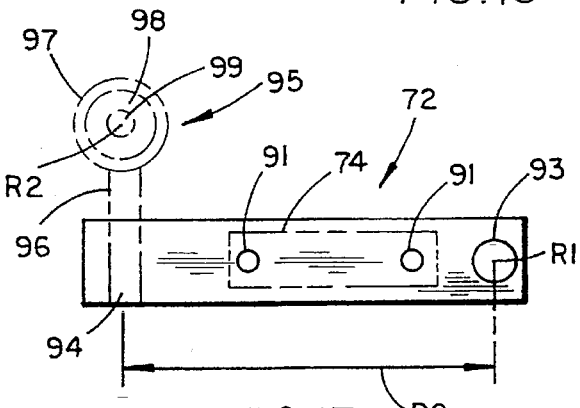
FIG. 13 is an enlarged side view of the right end member shown in FIG. 9.

Arm 72 is not unlike arm 71 in that arm 72 includes attachment holes 91 for receiving bolts to secure arm 72 to flange 74, a hole 93 for receiving a pivot pin extending from a corner post (56) of upper frame section 35, and another hole 94 for supporting a ball joint rod 95. Ball joint rod 95 includes a threaded stud 96 for engaging hole 94 and a protruding enlarged end 97 supporting an apertured ball 98. Ball 98 includes a hole 99 so that it forms an angularly adjustable joint for rotatably supporting one end of blade holder 30. Notably, the distance between holes 78 and 79 in arm 71 (FIG. 12) is a dimension D1, while the distance between holes 93 and 94 in arm 72 (FIG. 13) is a different dimension D2. This causes blade holder 30 to move in a non-parallel "cocked" orientation as it is rotated about the axis of rotation R1 defined by holes 78 and 93 (FIG. 7). Holes 90 and 99 in balls 89 and 98 define a second axis of rotation R2 that is non-parallel axis R1.

Figure 15:
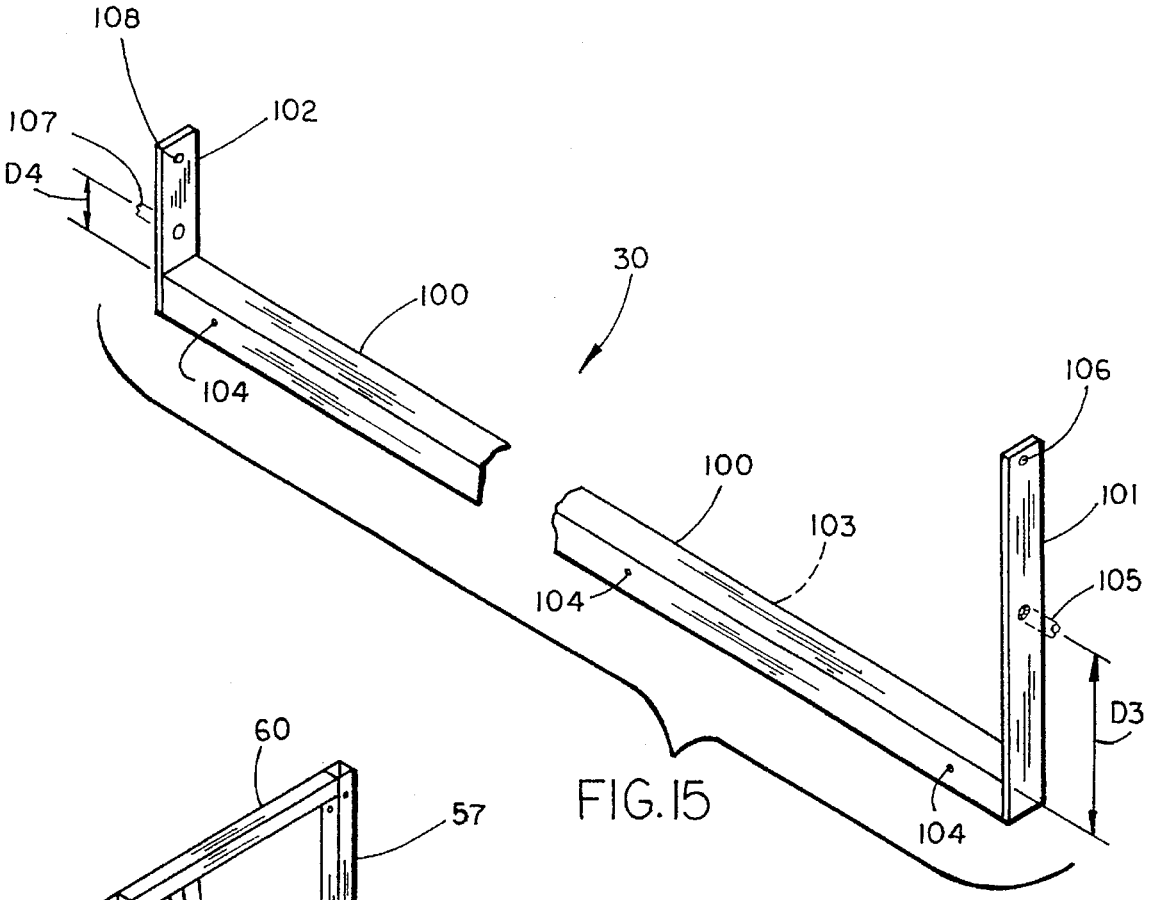
FIG. 15 is a fragmentary perspective view of the blade holder of the sheet cutting device.
Figure 19:
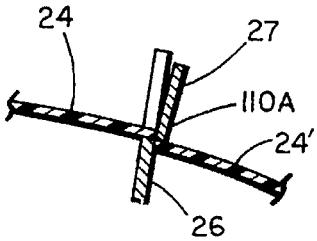

Blade holder 30 (FIG. 15) includes a cross beam 100, and a pair of end members 101 and 102 secured thereto. The side 103 of cross beam 100 generally proximate fixed blade 37 is planar and includes holes 104 for receiving bolts to secure the moveable blade (27) to cross beam side 103. Blades 26 and 27 are elongated, linearly-shaped bars having a rectangular shape, as shown in FIG. 19, and thus mateably engage their holders 66 and 100, respectively. End member 101 includes a pivot pin 105 and a hole 106, and end member 102 includes a pivot pin 107 and a hole 108. Hole 106 is configured to receive an end of spring 32 (FIG. 7). Hole 108 is configured to receive an end of a second spring comparable to spring 32 if an additional spring force is needed to bias moveable blade 27 against fixed blade 26. The distance D3 on end member 101 from pivot pin 105 to cross beam side 103 (i.e. to moveable blade 27) is significantly longer than the distance D4 on end member 102 from pivot pin 107 to cross beam side 103 (i.e. to moveable blade 27). This further causes moveable blade 27 to be positioned at a skewed "scissor-like" position relative to fixed blade 26.

Figure 18:
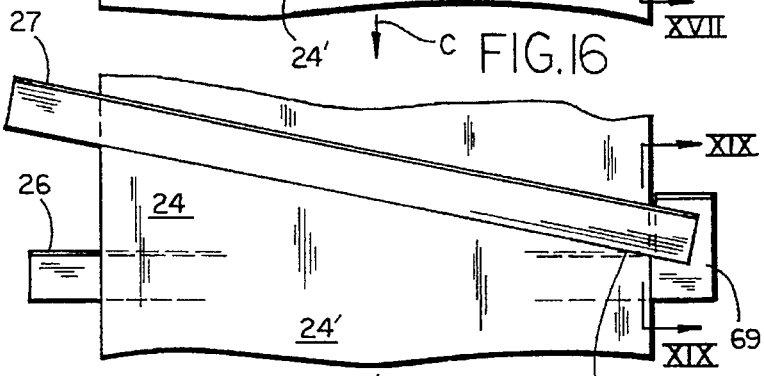
Figure 21:
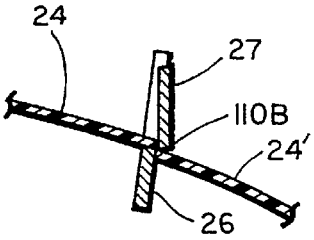
Figure 20:
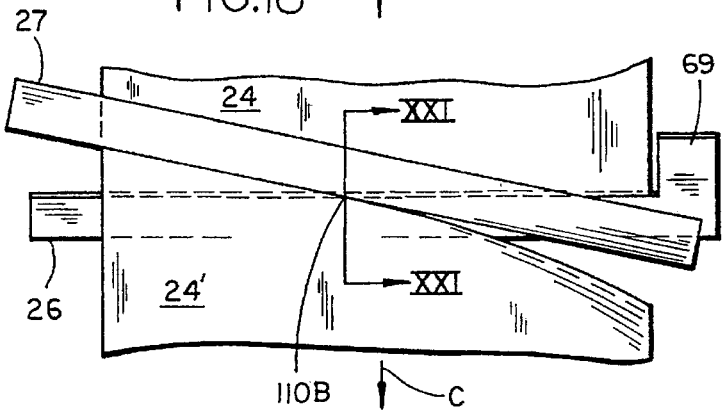
Figure 23:
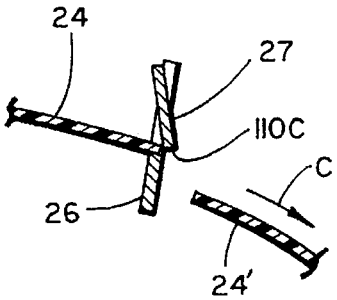
Figure 22:
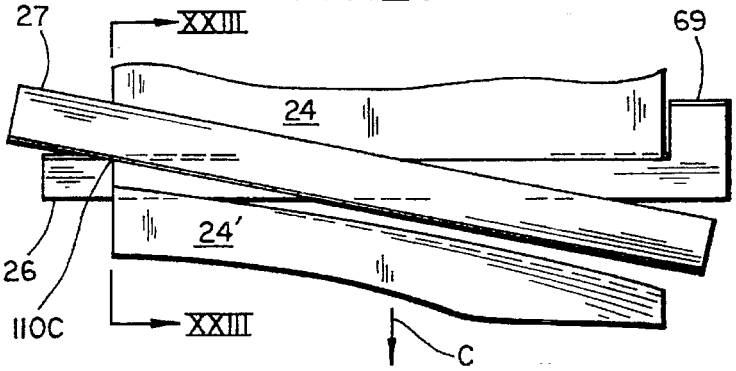
Figure 24:
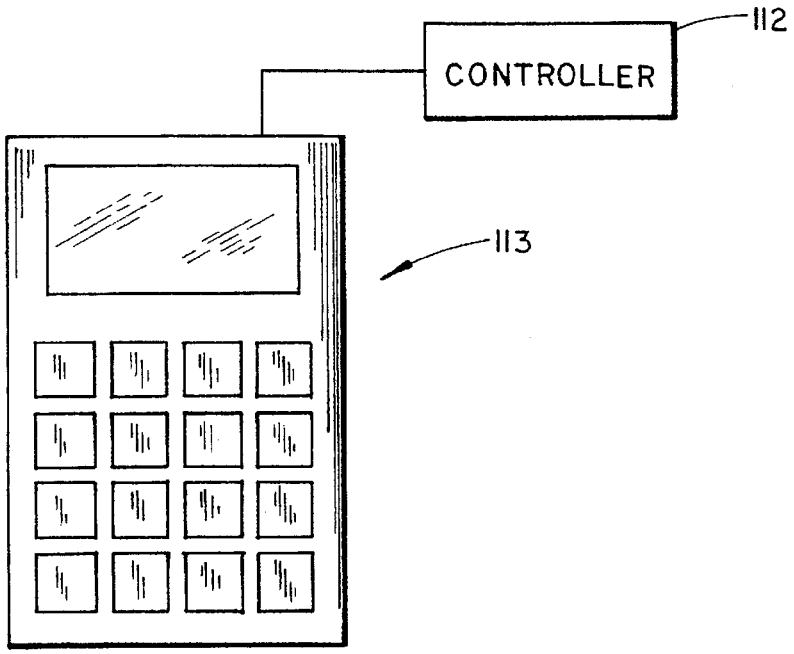
FIG. 24 is a plan view of a keypad operably connected to the programmable controller of the sheet cutting device.

The tension of spring 32 (FIG. 7) causes blade holder 30 to rotate about axis R2 in direction "A". This causes movable blade 27 to pivot into engagement with fixed blade 26. As swing member 29 is pivoted about axis R1 by actuator 31, blade holder 30 rotates about axis R2 so that moveable blade 27 continuously engages fixed blade 26. The angle of movable blade 27 relative to fixed blade 27 causes the blades 26 and 27 to shearingly engage along a shifting point of contact as illustrated by points 110A–110C in FIGS. 18, 20 and 22, respectively. Specifically, movable blade 26 is initially positioned in a raised "ready" position where it engages blade guide 69 (FIGS. 4,5,16, and 17). As actuator 31 moves movable blade 27 downwardly along a direction "B", movable blade 27 moves to a cut-initiating position where it initially engages fixed blade 26 and sheet material 24 on the "right" side of device 20 (FIGS. 18–19). Movable blade 26 further moves through a cutting stroke (FIGS. 20–21) to a cut-terminating position (FIGS. 22–23). As movable blade 27 moves past fixed blade 26, movable blade 27 moves with a curvilinear sweeping motion that is as least partially toward the outlet aperture 33. This movement and the fact that the "right" end of movable blade 27 is significantly below the corresponding part of fixed blade 26 when movable blade 27 is completing its movement provides a "kick" that helps move each newly cut section 24' away from the cutter blades 26 and 27 toward outlet aperture 33. Once cut free, the newly cut section slides out outlet aperture 33 along chute 33' (FIG. 7).

A further benefit of the knife blade arrangement is that flat, linearly shaped bar stock can be used to make blades 26 and 27 without major rework or shaping of the cutting edges of the blades. Still further, the tension of spring 32 can be adjusted to an optimal blade pressure to promote long blade life. In other words, the blade tension can be adjusted to a minimum pressure to promote blade life (i.e. prevent premature wear and hence minimize the frequency of resharpening) and can be adjusted to a sufficiently high pressure to assure a clean cut (i.e. prevent poor cutting due to wedging of uncut sheet material between the blades, thus leading to imperfect cuts, jamming, bunching and the like). Notably, the shearing engagement of blades 26 and 27 causes the blades to wear in a manner that keeps the cutting edges sharp.

Figure 25:
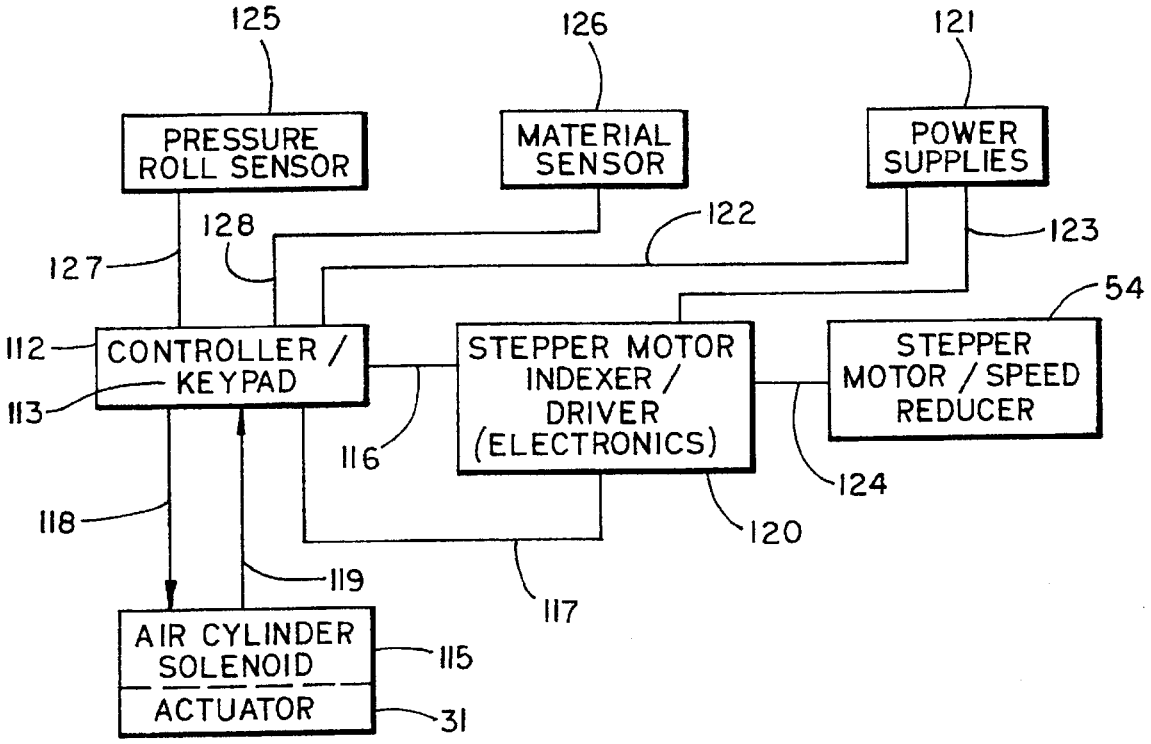
FIG. 25 is an electrical schematic view of the controller, the stepper motor, and the air cylinder/blade actuator for the sheet cutting device.

An electrical control circuit for sheet cutting device 20 is shown in FIG. 25. A controller 112 and stepper motor indexer/driver 120 are operably interconnected by wire 116 and further are connected to power supplies 121 by wires 122 and 123, respectively. Further, stepper motor indexer/driver 120, such as an IM1007I indexer/driver supplied by Intelligent Motion Systems, Inc. of Taftville, Conn., is operably connected to stepper motor 54 by wire 124, and sensors such as pressure roll sensor 125 and material sensor 126 are operably connected to controller 112 by wires 127 and 128, respectively. A feedback circuit 117 connects stepper motor indexer/driver 120 to controller 112, and controller 112 is programmed to control air cylinder solenoid 115 by means of connecting wire 118 and feedback circuit 119.

A control panel 114 (FIGS. 1–3) is mounted on a side of housing 34 proximate upper frame corner post 55. Controller 112 is mounted to the inside of control panel 114, and keypad 113 is mounted on the outside of control panel 114 in an accessible position. Controller 112 is programmable to preset the number of sheet sections 24' to be cut, and the length of each sheet. Further, controller 112 can be programmed for automatic, semi-automatic, manual operation, or at least three different batch operations.

Figure 16:
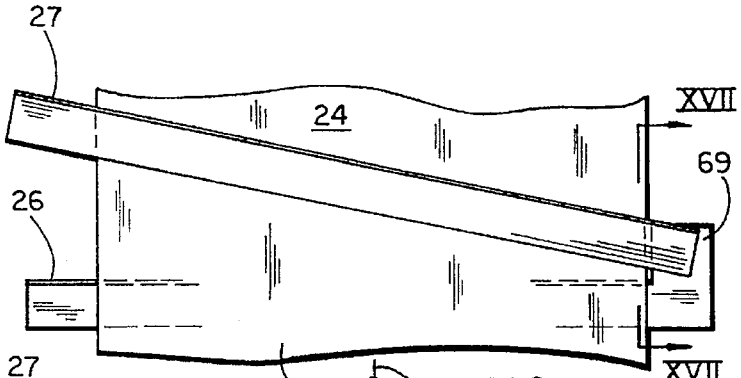
FIGS. 16, 18, 20 and 22 are front elevational views of the moveable blade being moved with a curvilinear sweeping motion from a raised "ready" position in FIG. 16 to a cut-initiating position in FIG. 18, a mid-point along a cutting stroke in FIG. 20, to a lowered cut-terminating position in FIG. 22.

To operate sheet cutting device 20, movable blade 27 is lifted to the raised "ready" position by actuator 31. Controller 112 is programmed for a particular sequence, and device 20 is otherwise readied for operation. Sequentially, feeder 23 expends a predetermined length of sheet material 24 between blades 26 and 27 (FIG. 16). Actuator 31 is then activated to lower movable blade 27 through a cut-initiating position (FIG. 18) and a cutting stroke (FIG. 20) to a cut-terminating position (FIG. 22). As movable blade 27 reaches the cut-terminating position, it "kicks" the newly cut sheet 24' away from the blade 27 in a direction "C" toward the outlet aperture 33 of device 20. Movable blade 27 is then returned to the raised, ready position (FIG. 16) for the next cut. The operation is repeated as many times as required.

Thus, a sheet cutting device is provided that includes a blade arrangement particularly adapted for cutting sheet material. The blade arrangement assists in exiting each newly cut section of sheet material, and further is readily adjustable to prolong blade life. Having described the invention, it should be understood that although a preferred embodiment has been disclosed herein, other modifications and embodiments can be utilized without departing from the spirit of this invention. Therefore, this invention should not be limited to only the embodiment illustrated.

The embodiments of the invention in which an exclusive property or privilege is claimed are defined as follows:

1. A sheet cutting device for cutting sheet material into sections, comprising:

a support;

an elongated fixed blade secured to said support and having a predetermined length at least as long as a maximum width of sheet material to be cut;

a blade-supporting mechanism including a swing member pivotally connected to said support for movement about a first axis and a blade holder pivotally connected to said swing member for movement about a second axis that extends at an angle to said first axis, said first and second axes being spaced apart;

an elongated second blade secured to said blade holder;

an actuator operably connected to said blade-supporting mechanism for rotating said blade-supporting mechanism about said first axis; and a spring attached to said blade holder for biasing said blade holder about said second axis so that said elongated second blade continuously shearingly engages said fixed blade when said blade holder is rotated by said actuator.

2. A sheet cutting device as defined in claim 1 wherein said fixed and second blades are linearly shaped and both extend across a width of the sheet material.

3. A sheet cutting device for cutting sheet material into sections, comprising:

a support;

an elongated fixed blade secured to said support and having a predetermined length at least as long as a maximum width of sheet material to be cut;

a blade-supporting mechanism including a swing member pivotally connected to said support for movement about a first axis and a blade holder pivotally connected to said swing member for movement about a second axis, said first and second axes being spaced apart, said swing member including first and second pivot arms that are unequal in length;

an elongated second blade secured to said blade holder;

an actuator operably connected to said blade-supporting mechanism for rotating said blade-supporting mechanism about said first axis; and a spring attached to said blade holder for biasing said blade holder about said second axis so that said elongated second blade continuously shearingly engages said fixed blade when said blade holder is rotated by said actuator.

4. A sheet cutting device as defined in claim 3 wherein said blade holder includes first and second end members that are unequal in length.

5. A sheet cutting device as defined in claim 1 including a feeder for feeding sheet material between said fixed and second blades.

6. A sheet cutting device as defined in claim 5 wherein said feeder includes a stepper motor for controlling an amount of sheet material expended between said fixed and second blades.

7. A sheet cutting device as defined in claim 6 including a friction drive wheel and a speed reduction device operably connected to said stepper motor for controlling the rate of sheet material expended between said fixed and second blades.

8. A sheet cutting device as defined in claim 7 including an axle engaging the support for supporting a roll of sheet material, and a friction brake for stopping rotation of the roll of sheet material when the stepper motor stops.

9. A sheet cutting device as defined in claim 1 wherein said fixed and second blades comprise linearly shaped bars of steel.

10. A sheet cutting device for cutting sections from a supply of sheet material, comprising:

a housing defining an output aperture for outputting a section of sheet material;

a fixed blade supported in said housing;

a second blade;

a blade-supporting mechanism for movably supporting said second blade in said housing for non-planar movement past said fixed blade, said fixed and second blades comprising non-parallel bars, said blade-supporting mechanism including means for holding said second blade at an angle relative to said fixed blade and including means for moving said second blade with a curvilinear sweeping motion so that said second blade continuously engages said fixed blade at a continuously shifting shear point as said second blade is moved along a cutting stroke from a cut-initiating position to a cut-terminating position, said second blade, when proximate said cut-terminating position, moving in a direction at least partially toward said output aperture so that said second blade kicks each newly cut section away from said fixed blade toward said output aperture.

11. A sheet cutting device as defined in claim 10 including a frame and wherein said means for holding includes a swing member movably connected to said frame, and further includes a blade holder movably connected to said swing member.

12. A sheet cutting device as defined in claim 11 wherein said fixed and second blades comprise linearly elongated bars having a constant cross section.

13. A sheet cutting device as defined in claim 11 wherein said swing member includes first and second arms that are unequal in length.

14. A sheet cutting device as defined in claim 11 wherein said blade holder includes first and second end members that are unequal in length.

15. A sheet cutting device as defined in claim 10 including a feeder for feeding sheet material between said fixed and second blades.

16. A sheet cutting device as defined in claim 15 wherein said feeder includes a stepper motor for controlling an amount of sheet material expended between said fixed and second blades.

* * * * *